US010188202B1

(12) United States Patent
Cincotta

(10) Patent No.: US 10,188,202 B1
(45) Date of Patent: Jan. 29, 2019

(54) BROOM WITH REPLACEABLE BRUSH CARTRIDGE

(71) Applicant: Bradshaw International, Inc., Rancho Cucamonga, CA (US)

(72) Inventor: Evan Carman Cincotta, Crompond, NY (US)

(73) Assignee: Bradshaw International, Inc., Rancho Cucamonga, CA (US)

( * ) Notice: Subject to any disclaimer, the term of this patent is extended or adjusted under 35 U.S.C. 154(b) by 0 days.

(21) Appl. No.: 15/917,620

(22) Filed: Mar. 10, 2018

(51) Int. Cl.

| | |
|---|---|
| ***A46B 5/02*** | (2006.01) |
| ***A46B 7/04*** | (2006.01) |
| ***B25G 3/28*** | (2006.01) |
| ***A46B 5/00*** | (2006.01) |

(52) U.S. Cl.
CPC ..... *A46B 7/044* (2013.01); *A46B 5/0095* (2013.01); *A46B 5/02* (2013.01); *B25G 3/28* (2013.01)

(58) Field of Classification Search
CPC ..... A46B 7/042; A46B 7/044; A46B 5/0095; A46B 5/02; B25G 3/28
USPC ..... 15/143.1, 159.1, 171
See application file for complete search history.

(56) References Cited

U.S. PATENT DOCUMENTS

| | | | | | |
|---|---|---|---|---|---|
| 62,768 | A * | 3/1867 | Miller | A46B 3/08 | 15/171 |
| 4,541,139 | A * | 9/1985 | Jones | B25G 3/22 | 15/145 |
| 5,414,889 | A * | 5/1995 | Sartori | A46B 5/0075 | 15/144.1 |
| 5,555,590 | A * | 9/1996 | Blum | A46B 7/04 | 15/167.1 |
| 5,809,604 | A * | 9/1998 | Olstyn | B25G 3/06 | 15/111 |
| 8,161,592 | B2 * | 4/2012 | Weis | A46B 5/0095 | 15/159.1 |
| 2009/0223007 | A1 * | 9/2009 | Li | A46B 5/0095 | 15/105 |

* cited by examiner

*Primary Examiner* — Randall Chin
(74) *Attorney, Agent, or Firm* — Mintz, Levin, Cohn, Ferris, Glovsky and Popeo, P.C.

(57) ABSTRACT

A broom with a replaceable brush cartridge is disclosed where the broom bristles can be replaced when worn. A brush cartridge is releasably retained by a broom head, and can be easily removed when needed. A replacement brush cartridge slides onto the broom head with a groove and track arrangement, and is locked into place with a wedge affixed to a live hinge on the brush cartridge that interacts with a wedge retainer on the broom head. A release tab moves the wedge away from the wedge retainer to unlock the brush cartridge from the broom head, allowing it to slide freely away. A new brush cartridge is then slid onto the track of the broom head, with the wedge and wedge retainer releasably engaging and locking the new brush cartridge to the broom head. The broom can be used as a pole broom or as a hand broom with a quick release retention button serving to release and reattach the pole as needed.

12 Claims, 12 Drawing Sheets

BROOM WITH REPLACEABLE BRUSH CARTRIDGE

BACKGROUND OF THE INVENTION

1. Field of the Invention

This invention relates generally to cleaning devices, and more specifically to a broom with a replaceable brush cartridge.

2. Description of Related Art

Brooms are common cleaning devices that have been used for hundreds if not thousands of years. Bundles of natural material such as twigs, grass, and corn husks were used in ancient times to clean floors and hearth areas. A popular material for making brooms were branches of the broom plant, a yellow flowering shrub. As civilization advanced, broom making became a skilled trade with artisans known as "besom squires" in Anglo-Saxon England. Besom being the name for a cleaning tool consisting of a bundle of sticks or twigs used to whisk dirt away.

In the United States, a species of Sorghum known as broomcorn became the standard material for brooms in the northeastern United States, and an industry was born. The Shakers, a Christian religious sect that excelled at handicrafts, perfected various broom styles including the flat broom and the whisk broom.

With modern day materials such as plastics, many brooms are now made entirely from plastic, although there still remains a demand for natural fiber brooms. Whether natural fibers or plastic are used, over time the bristles of a broom will wear down, bend, deform, and break off, necessitating the need to replace the entire broom. Most modern brooms are sold as a complete product, including the pole. Therefore, replacing an entire broom when only the bristles have worn down is not only an added expense, it also represents a negative environmental impact due to waste associated with the discarded broom. While there have been limited attempts by some manufacturers to sell replacement broom heads without poles, this has been met with limited success, as it requires retail establishments to carry additional stock. Further, while replacing the broom head saves the waste of discarding a broom pole, the broom head itself is still discarded in its entirely when replacement is necessary.

What is needed is a broom with a replaceable brush cartridge. The ability to easily replace the broom pole or to use the broom head without the pole as a whisk broom would also be useful and beneficial.

It is thus an object of the present invention to provide a broom with a replaceable brush cartridge.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a broom with a replaceable brush cartridge comprising a broom head comprising a top side having a pole receiver for attachment to a pole and a bottom side having a retention skirt; a track disposed along an inner wall of the retention skirt; a cartridge receiver formed by the surrounding retention skirt; a wedge retainer located within the cartridge receiver; a brush cartridge having an elongated shape and a perimeter groove capable of receiving the track of the broom head; bristles affixed to the brush cartridge; a wedge with a live hinge connecting the wedge with the brush cartridge; the wedge positioned to engage with the wedge retainer of the cartridge receiver when the brush cartridge is installed in the cartridge receiver of the broom head.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
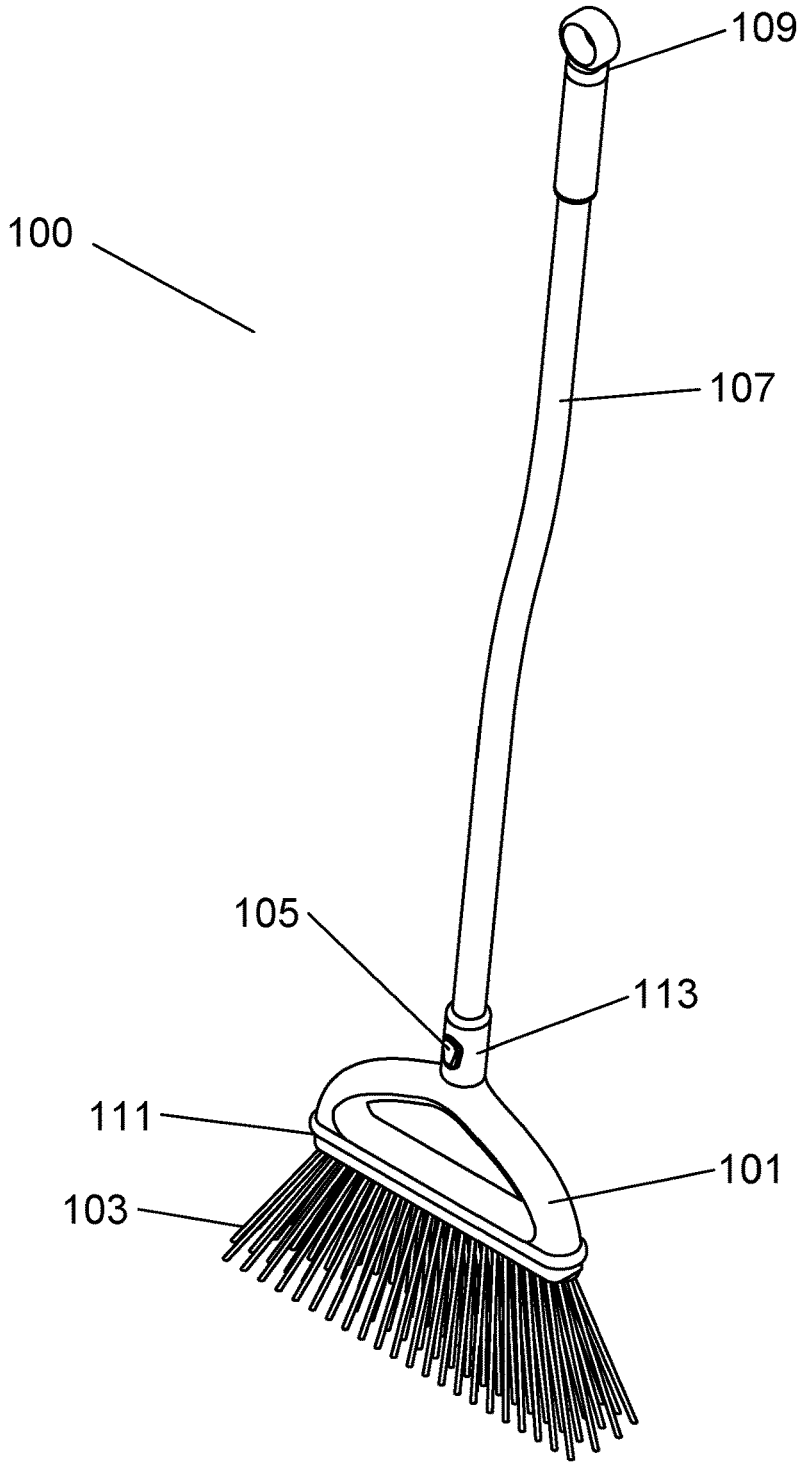
FIG. 1 is a perspective view of a broom with replaceable brush cartridge.

The attached figures depict various views of the broom with replaceable brush cartridge in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Broom with Replaceable Brush Cartridge is described and depicted by way of this specification and the attached drawings.

For a general understanding of the present invention, reference is made to the drawings. In the drawings, like reference numerals have been used throughout to designate identical elements.

Figure 14:
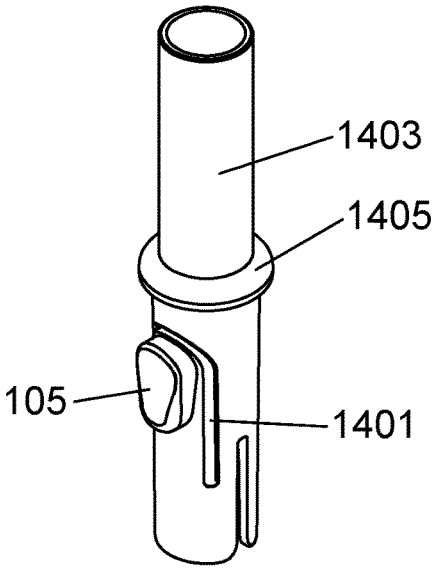
FIG. 14 is a perspective view of the broom head retainer of the broom of the present invention.

Referring to FIG. 1, a perspective view of the Broom with Replaceable Brush Cartridge 100 is shown. The Broom with Replaceable Brush Cartridge may be made from any suitable rigid or semi-rigid material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used. The various components of the Broom With Replaceable Brush Cartridge may be made by injection molding, blow molding, machining, extruding, or the like. The broom head can be seen in FIG. 1 as having a top side having a pole receiver 113 for attachment to a pole 107. The pole 107 may be made from a metal, plastic, wood, or the like, and has a broom head retainer 1403 (see FIG. 14) attached. The broom head retainer 1403, as seen in FIG. 14, has a retention button 105 to allow for removal or addition of the pole 107. This allows the broom head to be used as a hand broom or whisk broom. Of note is the handle 101 that also forms the structure of the broom head. The handle 101 has two arc or beam structures that meet at the pole receiver 113 and terminate toward either end of the broom head, creating an opening that allows a user to grasp the broom head with the formed handle 101. The handle 101 has two elements that join with cartridge receiver 1007 (see FIG. 1) or the retention skirt 1005 structure to form a generally triangular shape that in turn may be used as a handle.

Also depicted in FIG. 1, and as will be further described herein, is a replaceable brush cartridge 111 that is removably engaged with the broom head. The brush cartridge 111 has bristles 103 or other cleaning structures. The bristles may be made from a synthetic material such as nylon or other plastic, or may, in some embodiments of the present invention, be made from a natural fiber. The brush cartridge 111 is also locked or otherwise captured in place to prevent unwanted movement of the brush cartridge 111 in the cartridge receiver 1007 (see FIG. 10) of the broom head. This locking arrangement will be further described later in this specification.

FIG. 1 also depicts an annular end 109 that may be present in some embodiments of the present invention. The annular end 109, further depicted in FIG. 17, has a cylindrical sleeve that mates with the pole 107 and an annular form that may also, in some embodiments, swivel or rotate about the axis of the cylindrical sleeve. This allows for the Broom with replaceable brush cartridge to be hung or otherwise stored conveniently.

Figure 2:
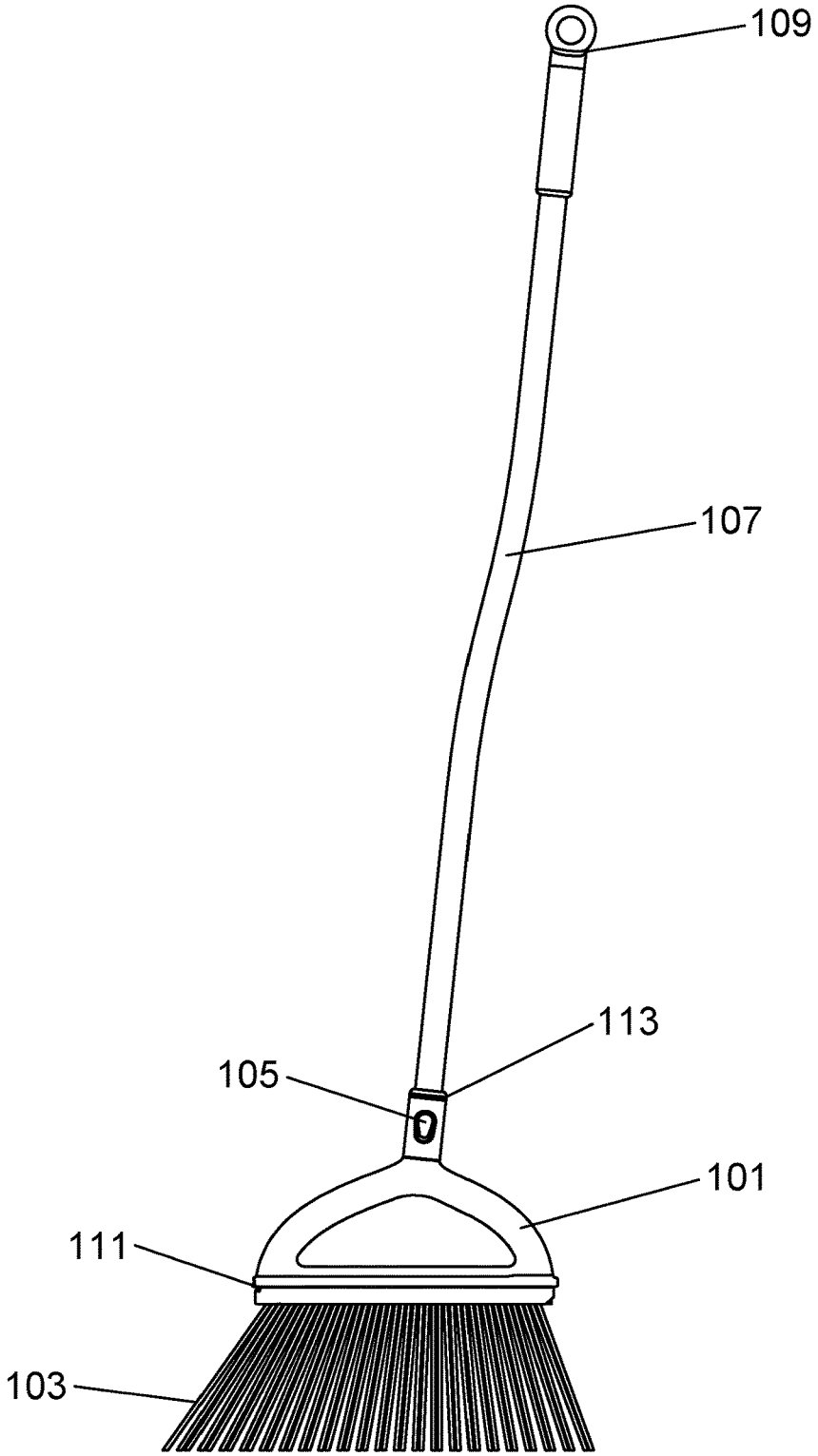
FIG. 2 is a plan view of the broom with replaceable brush cartridge.

FIG. 2 is a plan view of the broom with replaceable brush cartridge showing clearly the handle 101 formed as a triangular or arced triangular shape in the embodiment of the present invention depicted.

Figure 3:
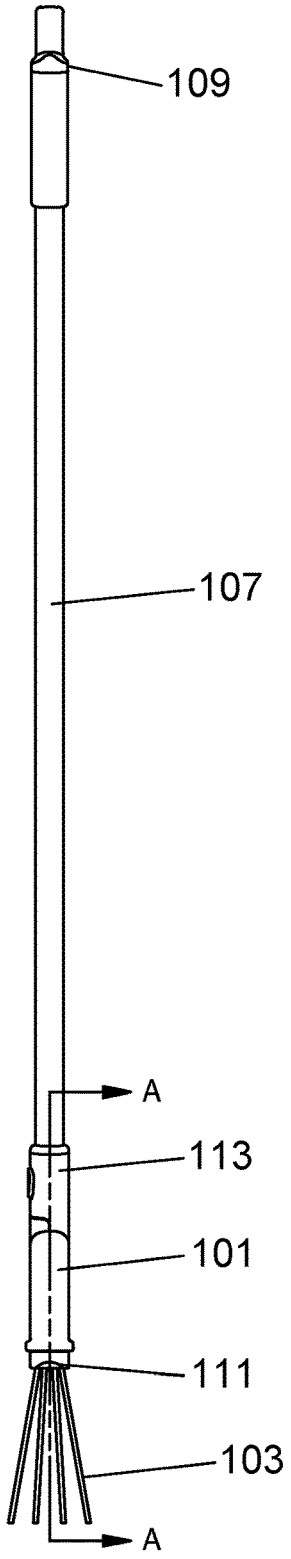
FIG. 3 is a side view of the broom with replaceable brush cartridge.

FIG. 3 is a side view of the broom with replaceable brush cartridge. The brush cartridge 111 can be seen in place with the broom head.

Figure 4:
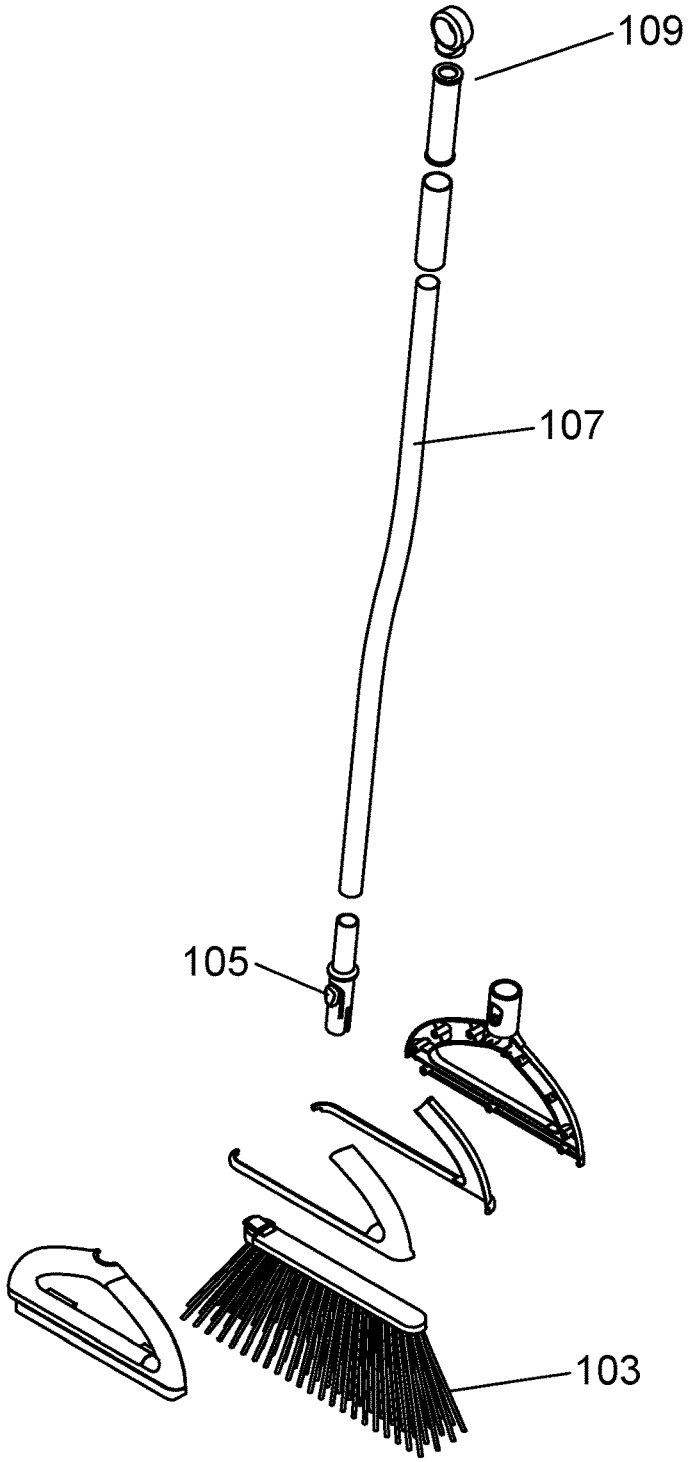
FIG. 4 is an exploded view of the broom with replaceable brush cartridge.

FIG. 4 is an exploded view of the broom with replaceable brush cartridge showing the various constituent components of the broom and the replaceable brush cartridge. While the broom head is depicted in several pieces that are in turn attached together by way of fasteners such as screws, bolts or adhesives, it is possible through various manufacturing techniques that the broom head is constructed as one piece, or a variety of pieces assembled together. In some embodiments of the present invention, a soft durometer overlay material may be incorporated into the broom head to prevent marring or damage to surrounding walls, woodwork, moldings, or the like, during use.

Figure 5:
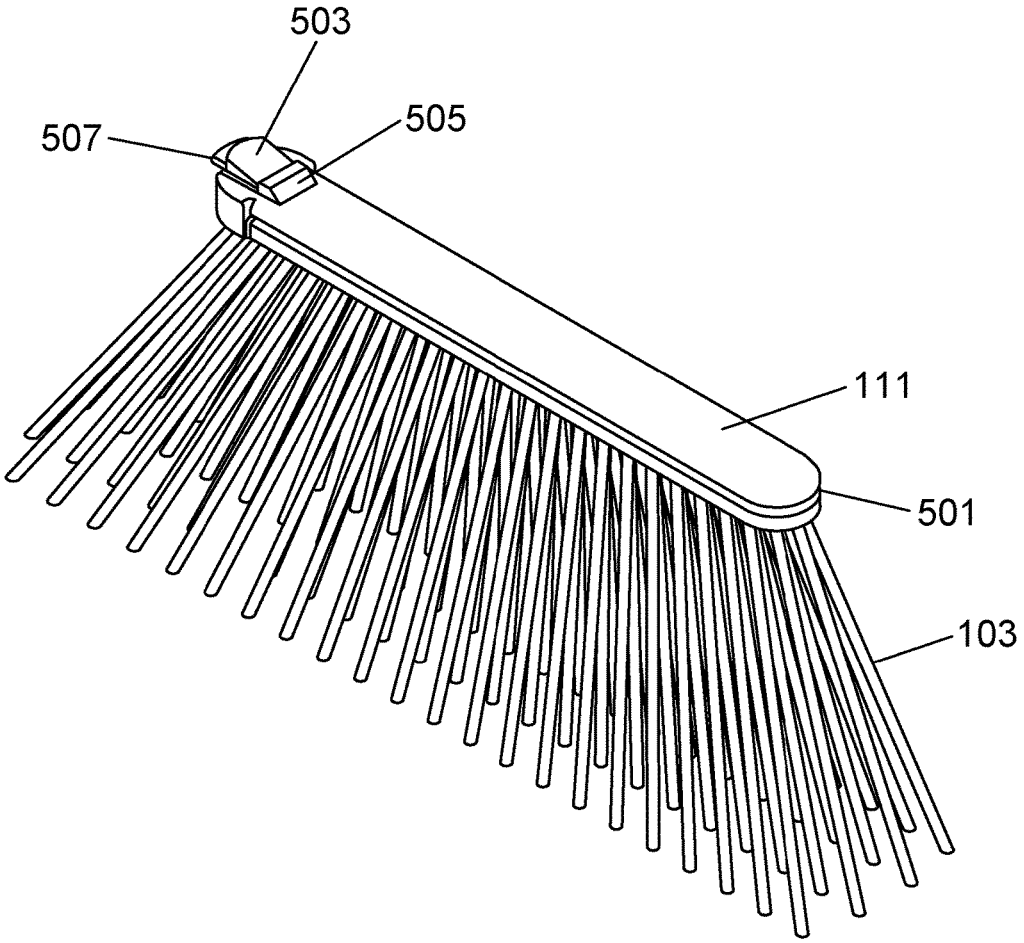
FIG. 5 is a perspective view of the brush cartridge.
Figure 12A:
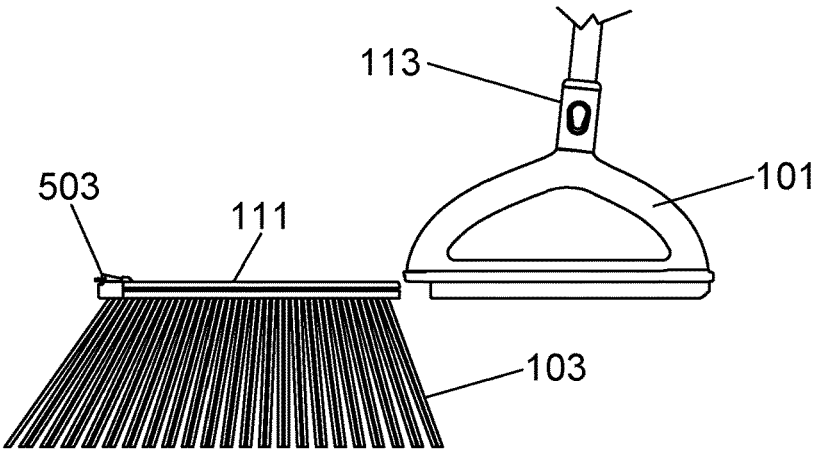
FIGS. 12*a*-12*c* depict the brush cartridge being installed on the broom of the present invention.
Figure 12B:
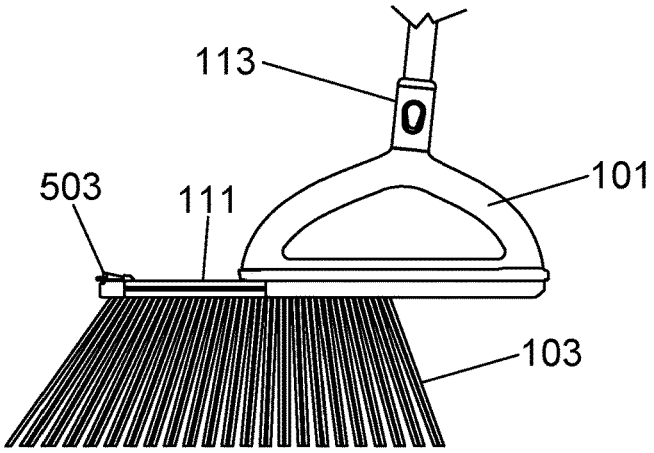
Figure 12C:
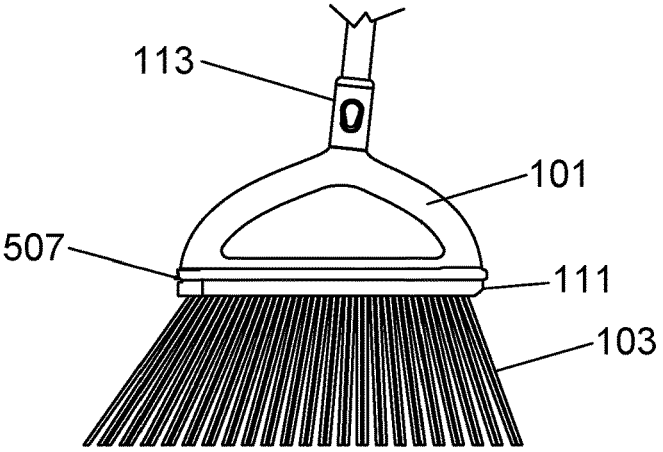
Figure 13:
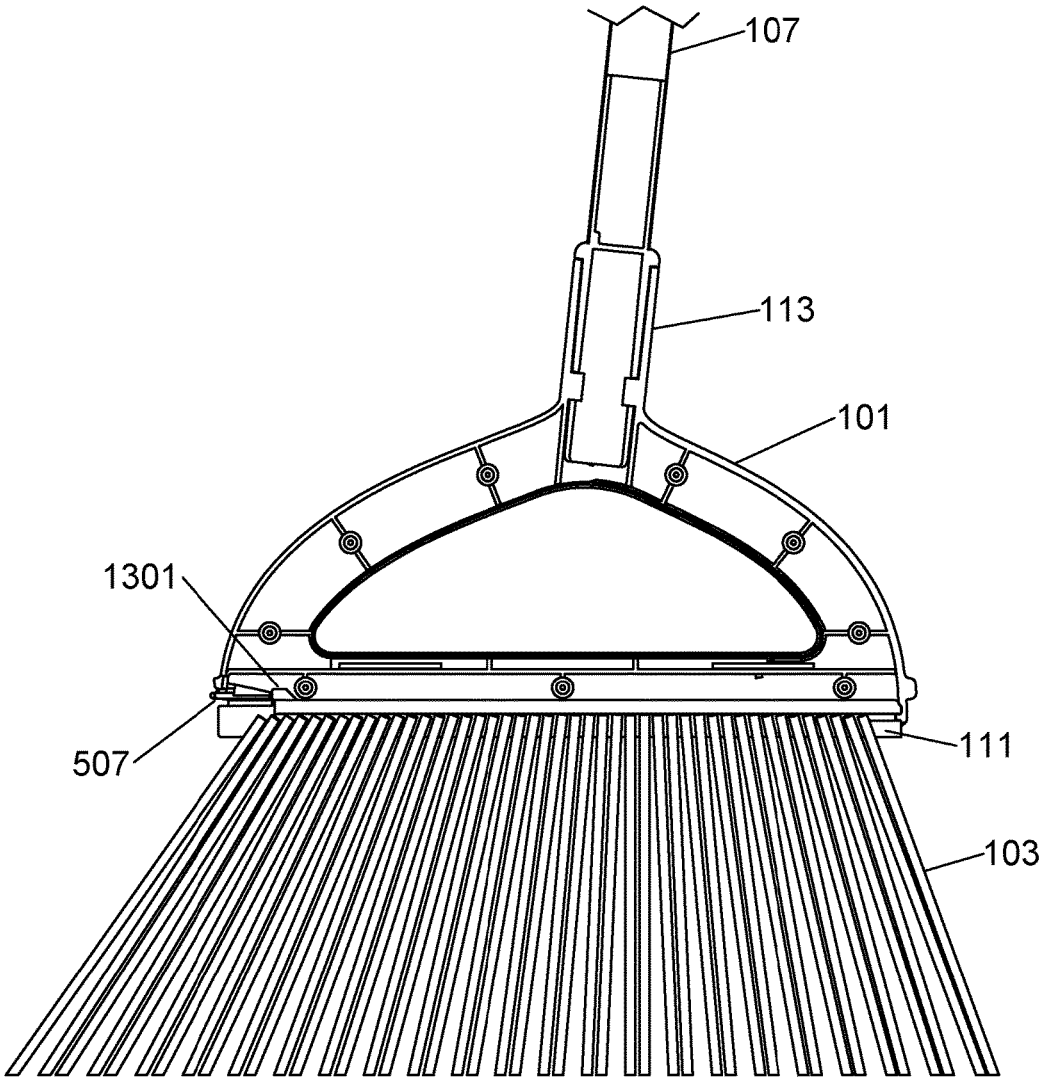
FIG. 13 is a cross sectional view of the broom taken along line A-A of FIG. 3.

Turning now to FIG. 5, a perspective view of the brush cartridge 111 is depicted. The brush cartridge has an elongated shape with a perimeter groove 501 capable of receiving the track of the broom head shown in FIG. 10 (1001, 1003). The perimeter groove 501 may be continuous around the cartridge substrate, or may, in some embodiments, extend along two sides of the cartridge substrate, or three sides thereof. The perimeter groove may be formed as a square or rectangular channel to receive the track of the cartridge receiver of the broom head. The substrate or upper portion of the brush cartridge may be rounded or otherwise tapered at the leading end for ease of installation. Further, the substrate or upper portion is made from a suitable plastic or similar material and contains a plurality of bristles 103. The bristles may be made from a synthetic material such as nylon or other plastic, or may, in some embodiments of the present invention, be made from a natural fiber. To retain the brush cartridge 111 into the cartridge receiver as depicted in FIGS. 12*a*-12*c*, a wedge is connected to the brush cartridge with a live hinge. The live hinge is a flexible portion of a material such as a plastic that allows the wedge to move and return to its original position with some force. The wedge may be triangular, and engages with a wedge retainer 1301 as shown in FIG. 13. The wedge may also comprise several portions or sections, such as the trailing wedge 503 and the leading wedge 505 shown in FIG. 5. A release tab 507 can also be seen attached to the trailing wedge 503. The release tab protrudes from the trailing wedge 503 (or a wedge if only one triangular form is used) and allows a user to push the release tab in a direction generally perpendicular to the wedge so to cause the wedge to move away from the wedge retainer of the cartridge receiver, releasing the brush cartridge and allowing it to slide freely from the cartridge receiver.

Figure 6:
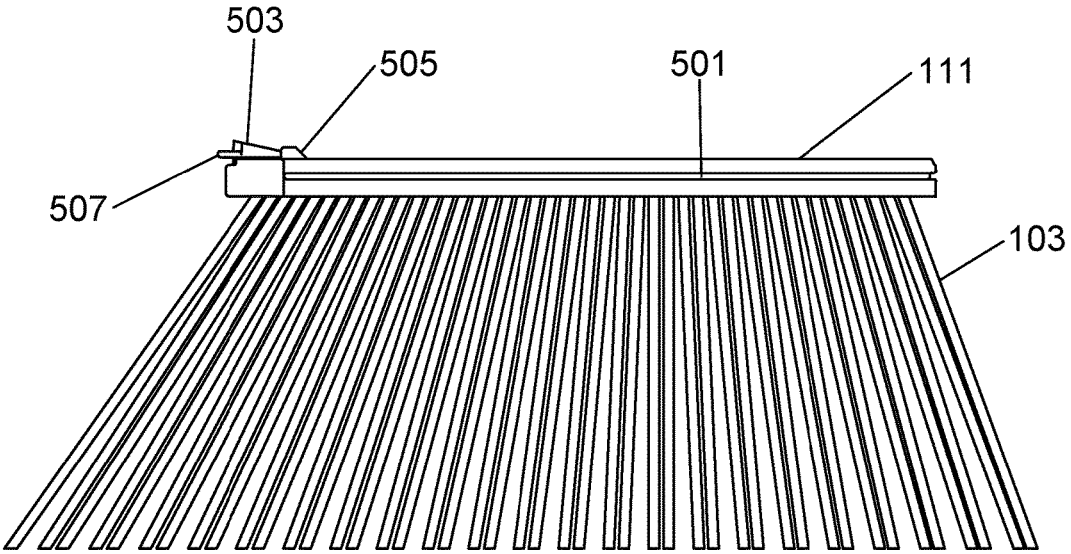
FIG. 6 is a side plan view of the brush cartridge.

FIG. 6 is a side plan view of the brush cartridge showing the wedge and live hinge attached to the brush substrate with bristles 103 attached to the substrate. The perimeter groove 501 can be clearly seen along with the trailing wedge 503 with the attached release tab 507. The live hinge is located to the front, or tapered portion of the trailing wedge 503. The leading wedge 505 can be seen as a truncated triangular shape, although other geometries may also be employed. The leading wedge 505 serves as a retainer or stop against the wedge retainer 1301 (see FIG. 13).

Figure 7:
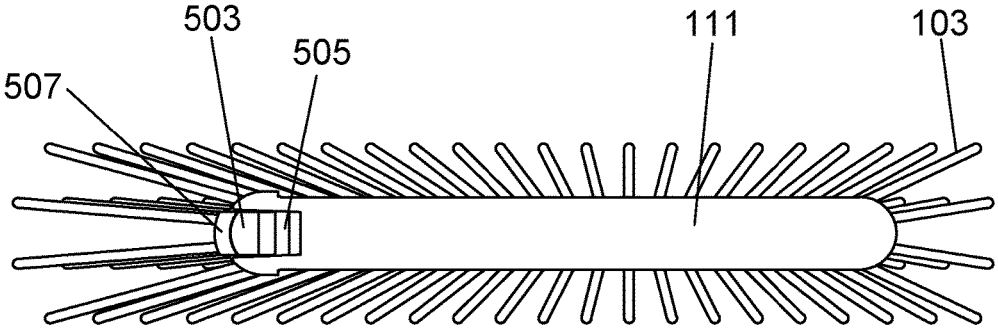
FIG. 7 is a top plan view of the brush cartridge.

FIG. 7 is a top plan view of the brush cartridge 111 showing how the release tab 507 protrudes from the trailing side of the brush substrate. This is depicted clearly in FIG. 12*c*.

Figure 8:
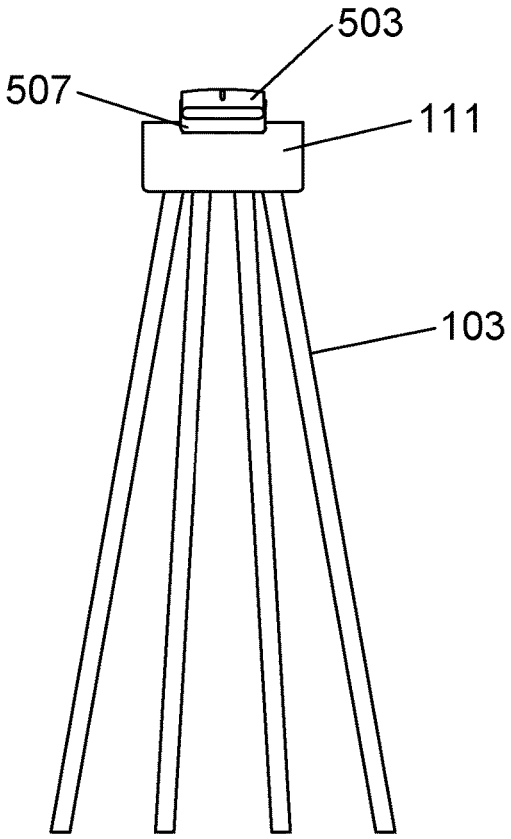
FIG. 8 is an end plan view of the brush cartridge.

FIG. 8 is an end plan view of the brush cartridge 111 showing the trailing wedge 503 and the attached release tab 507.

Figure 9:
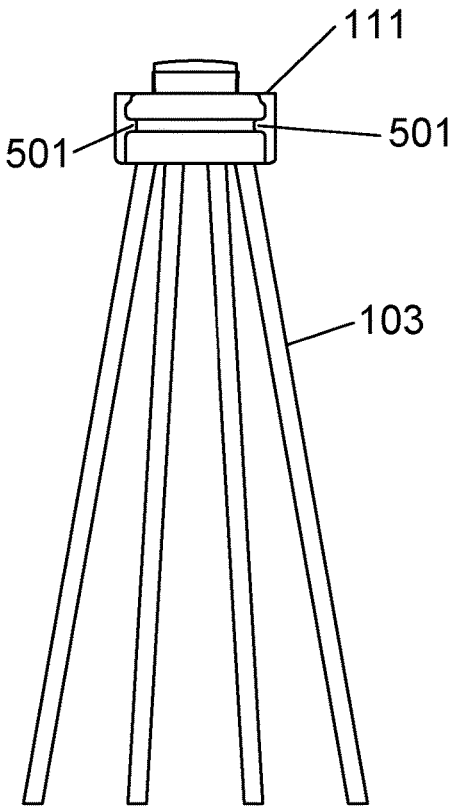
FIG. 9 is an alternate end plan view of the brush cartridge.

FIG. 9 is an alternate end plan view of the brush cartridge 111. The perimeter groove 501 can be seen on either of the longer sides. The perimeter groove 501 may also span the shorter side or sides of the brush cartridge.

Figure 10:
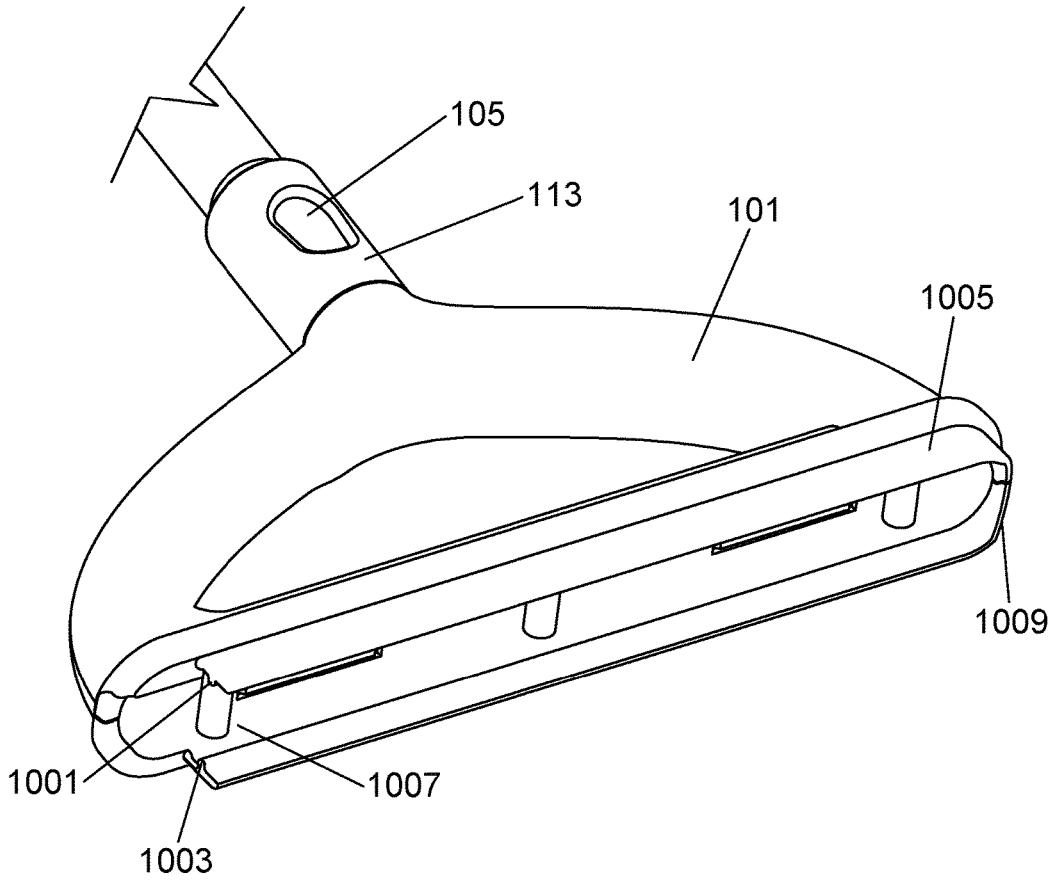
FIG. 10 is an underside perspective view of the broom head with the brush cartridge removed.

Turning to FIG. 10, an underside perspective view of the broom head with the brush cartridge removed can be seen. A retention skirt 1005 can be seen that has an inner wall and creates an opening to receive the brush cartridge (a cartridge receiver 1007). This cartridge receiver 1007 is of the same or a similar geometry to the brush cartridge and has a track disposed along the inner wall of the retention skirt. The cartridge receiver 1007 is thus formed by the surrounding retention skirt 1005. The track 1001 and 1003 can be seen, and protrude inwardly toward the cartridge receiver opening. The track 1001 and 1003 may be two separate tracks on each side of the cartridge receiver 1007, or may be one continuous track that travels around the end stop 1009 of the retention skirt 1005. The track may be rectangular, square, rounded, or of other suitable geometries to allow ease of sliding movement within the perimeter groove 501 of the brush cartridge 111. The cartridge receiver 1007 is also joined with an end stop 1009. The end stop 1009 may be where the retention skirt 1005 is closed or joined, thus presenting a side wall or end wall that stops the travel of a brush cartridge 111 being inserted into the cartridge receiver 1007.

Figure 11:
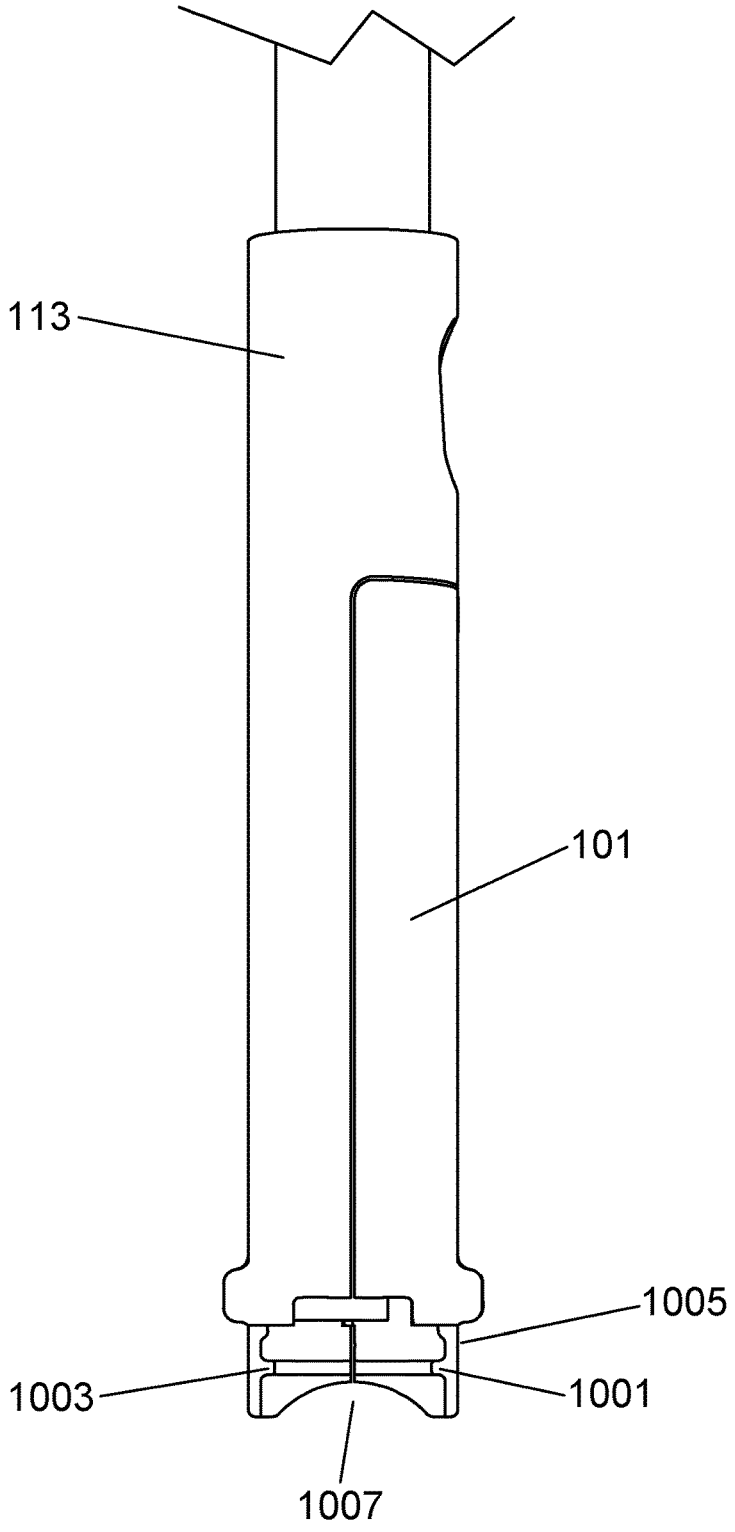
FIG. 11 is an end plan view of the broom head with the brush cartridge removed.

FIG. 11 is an end plan view of the broom head with the brush cartridge removed. In this view, the retention skirt 1005 can be seen forming the cartridge receiver 1007. The track 1001 and 1003 can also be seen protruding inwardly toward the cartridge receiver opening 1007.

To fully illustrate how to use the Broom with Replaceable Brush Cartridge, FIGS. 12*a*-12*c* depict the brush cartridge being installed on the broom of the present invention. As seen in FIG. 12*a*, the cartridge receiver is open at one end for receiving the brush cartridge 111. FIG. 12*b* shows the brush cartridge being moved into the cartridge receiver of the broom head, where the perimeter groove of the brush cartridge is aligned with the inner track 1001 and 1003 of the broom head (inside the cartridge receiver and not visible in this figure). Lastly, FIG. 12*c* depicts the brush cartridge 111 fully installed on the broom head and locked into place with the wedge and wedge retainer mechanism. To release the brush cartridge 111 from the broom head, the release tab 507 is depressed and held while the brush cartridge is slid out of the cartridge receiver 1007. The brush cartridge 111 is removed from the broom head when it is worn and should be replaced, for example, FIG. 13 is a cross sectional view of the broom taken along line A-A of FIG. 3.

From this cross section, the wedge retainer 1301 can be seen inserted between the trailing wedge and the leading wedge of the brush cartridge 111. The wedge retainer 1301 can be seen as a triangular protruding piece that conforms with the wedge assembly of the brush cartridge 111. In this view, the brush cartridge 111 is fully inserted into the cartridge receiver 1007 of the broom head, and is locked in place.

FIG. 14 is a perspective view of the broom head retainer of the broom of the present invention. The upper portion of the broom head retainer is affixed to a hollow pole such as the pole 107 depicted in FIG. 1. Fasteners or an adhesive may also be used to ensure a secure fit. A pole stop 1405 can also be seen where the diameter of the broom head retainer is larger at the pole stop 1405, preventing the broom head retainer from being inserted too deeply into the pole and also preventing the broom head retainer 1403 from being inserted too deeply into the pole receiver 113. The retention button 105 can be seen attached to a live hinge 1401 for releasably engaging with a hole in the pole receiver 113. The live hinge 1401 is formed as a cutout around the retention button 105 with a portion remaining attached.

Figure 15:
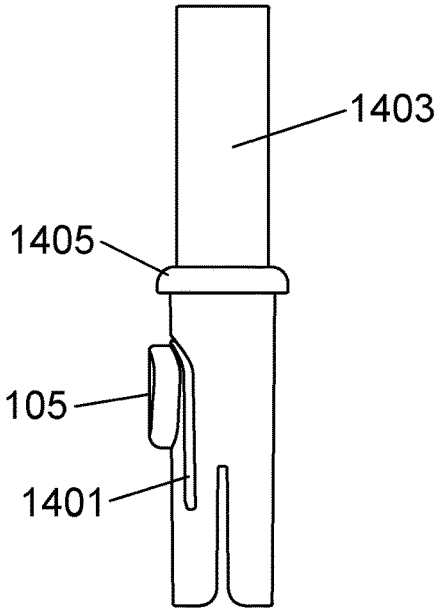
FIG. 15 is a side plan view of the broom head retainer of the broom of the present invention.

FIG. 15 is a side plan view of the broom head retainer of the broom of the present invention showing how the live hinge is formed as a U-shaped cutout of the cylindrical material that makes up the broom head retainer.

Figure 16:
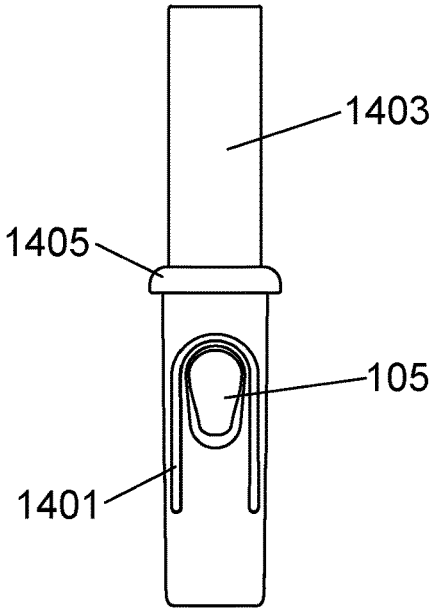
FIG. 16 is a plan view of the broom head retainer of the broom of the present invention.

FIG. 16 is a plan view of the broom head retainer of the broom of the present invention showing the retention button 105 and the lower section of the broom head retainer that is removably inserted in the pole receiver 113 and the upper section of the broom head retainer that is affixed to a pole.

Figure 17:
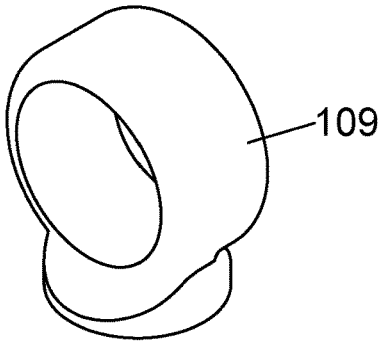
FIG. 17 is a perspective view of the annular end of the broom of the present invention.

Lastly, FIG. 17 is a perspective view of the annular end 109 of the broom of the present invention. The annular end 109 is attached to the pole 107 as seen in FIG. 1, and facilitates storage of the broom.

It is, therefore, apparent that there has been provided, in accordance with the various objects of the present invention, a Broom with Replaceable Brush Cartridge. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A broom with a replaceable brush cartridge comprising:
- a broom head comprising a top side having a pole receiver for attachment to a pole and a bottom side having a retention skirt;
- a track disposed along an inner wall of the retention skirt;
- a cartridge receiver formed by the surrounding retention skirt;
- a wedge retainer located within the cartridge receiver;
- a brush cartridge having an elongated shape and a perimeter groove capable of receiving the track of the broom head;
- bristles affixed to the brush cartridge;
- a wedge with a live hinge connecting the wedge with the brush cartridge;
- the wedge positioned to engage with the wedge retainer of the cartridge receiver when the brush cartridge is installed in the cartridge receiver of the broom head.

2. The broom with a replaceable brush cartridge of claim 1, wherein the wedge comprises a leading wedge and a trailing wedge.

3. The broom with a replaceable brush cartridge of claim 1, further comprising a release tab connected to the wedge.

4. The broom with a replaceable brush cartridge of claim 1, wherein the cartridge receiver is joined with an end stop.

5. The broom with a replaceable brush cartridge of claim 1, wherein the track disposed along an inner wall of the retention skirt protrudes inward toward the cartridge receiver.

6. The broom with a replaceable brush cartridge of claim 1, wherein the wedge is triangular.

7. The broom with a replaceable brush cartridge of claim 1, wherein the broom head is formed as a handle having an opening.

8. The broom with a replaceable brush cartridge of claim 1, wherein the perimeter groove of the brush cartridge is continuous.

9. The broom with a replaceable brush cartridge of claim 1, wherein the perimeter groove of the brush cartridge extends along two sides of the brush cartridge.

10. The broom with a replaceable brush cartridge of claim 1, wherein the perimeter groove of the brush cartridge extends along three sides of the brush cartridge.

11. A broom with a replaceable brush cartridge comprising:
- a broom head comprising a handle, a top side having a pole receiver for removable attachment to a pole, and a bottom side having a retention skirt;
- a broom head retainer comprising a retention button attached to a live hinge;
- a track disposed along an inner wall of the retention skirt;
- a cartridge receiver formed by the surrounding retention skirt;

a wedge retainer located within the cartridge receiver;

a brush cartridge having an elongated shape and a perimeter groove capable of receiving the track of the broom head;

bristles affixed to the brush cartridge;

a wedge with a live hinge connecting the wedge with the brush cartridge;

the wedge positioned to engage with the wedge retainer of the cartridge receiver when the brush cartridge is installed in the cartridge receiver of the broom head.

12. The broom with replaceable brush cartridge of claim 11, wherein the wedge comprises a leading wedge and a trailing wedge.

* * * * *